US007450873B2

(12) United States Patent
Sharma et al.

(10) Patent No.: US 7,450,873 B2
(45) Date of Patent: Nov. 11, 2008

(54) MARKING SYSTEM INVOLVING NON-BUSINESS USAGE

(75) Inventors: Gaurav Sharma, Webster, NY (US); Rita Sherman, Fairport, NY (US); Christopher Jon Regruit, Rochester, NY (US); Robert Rolleston, Rochester, NY (US); Shiram Revankar, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 224 days.

(21) Appl. No.: 11/514,277

(22) Filed: Sep. 1, 2006

(65) Prior Publication Data

US 2008/0056753 A1 Mar. 6, 2008

(51) Int. Cl.
*G03G 21/02* (2006.01)
*G03G 15/00* (2006.01)

(52) U.S. Cl. ..... 399/79; 399/8

(58) Field of Classification Search ..... 399/8, 399/9, 10, 11, 79, 80; 705/34
See application file for complete search history.

(56) References Cited

U.S. PATENT DOCUMENTS 6,216,113 B1 * 4/2001 Aikens et al. ..... 705/34
7,076,184 B2 * 7/2006 Zwiefelhofer ..... 399/79

* cited by examiner

*Primary Examiner*—Hoang Ngo
(74) *Attorney, Agent, or Firm*—James J. Ralabate

(57) ABSTRACT

This is a method for permitting an employee (user) authority to use his employer's marking apparatus for personal reasons. The supplier (provider) of the marking apparatus for example, Xerox Corporation, makes arrangements with the employee (with employer's approval) to use the marking apparatus for an agreed upon price; the marking apparatus having provisions for recording the employee's usage and conveying this to the provider. The provider administers the entire process and pays the employer a portion of the amount remitted by the employee user.

18 Claims, 1 Drawing Sheet

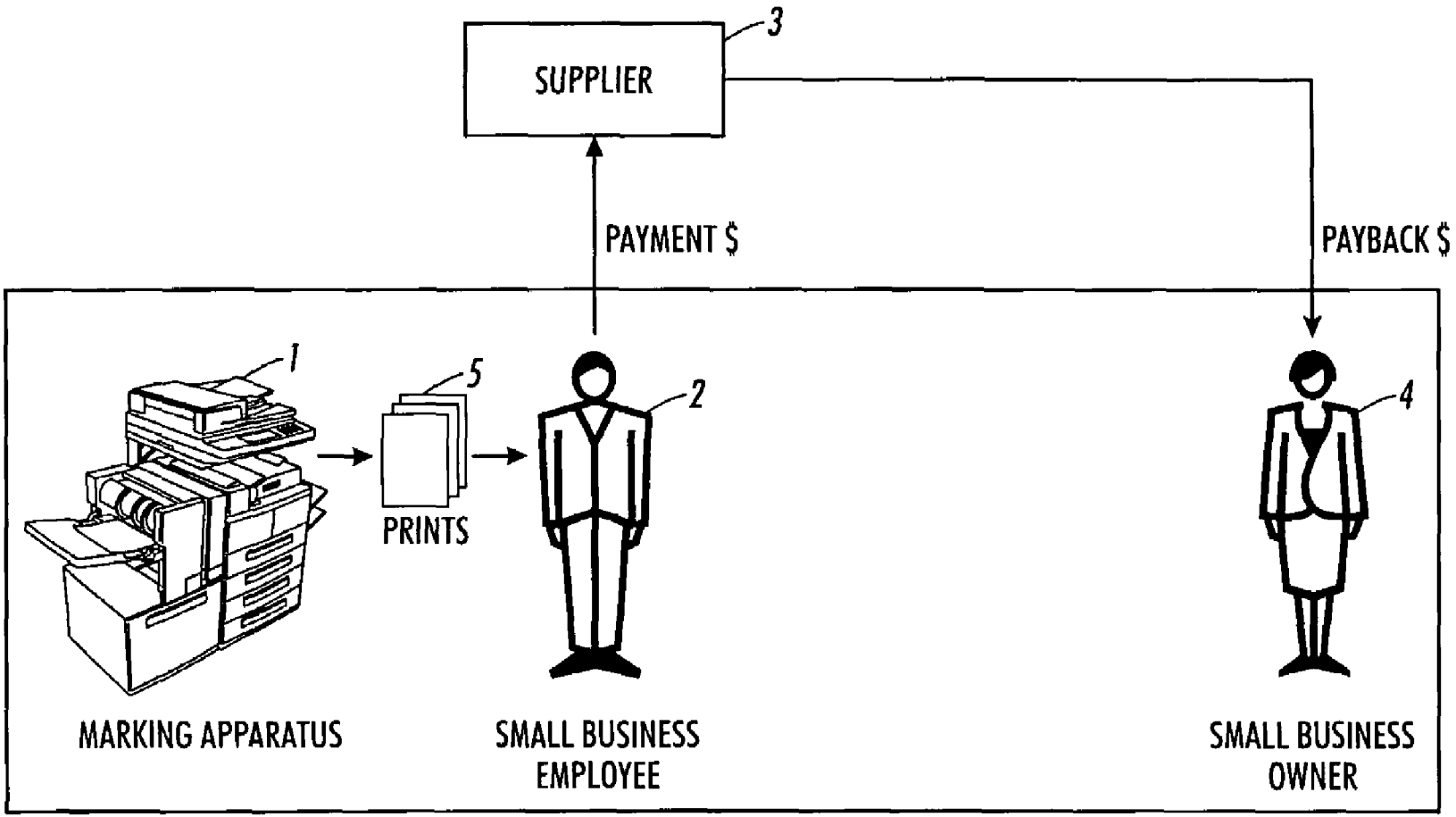
SUPPLIER
3
PAYMENT $
PAYBACK $
1
MARKING APPARATUS
5
PRINTS
2
SMALL BUSINESS EMPLOYEE
4
SMALL BUSINESS OWNER

MARKING SYSTEM INVOLVING NON-BUSINESS USAGE

FIELD

This invention generally relates to an electrostatic marking system, process and apparatus, and more specifically to an electrostatic marking system involving non-business usage.

BACKGROUND

In Xerography or an electrostatographic process, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The charged toner being electrostatically attached to the latent electrostatic image areas to create a visible replica of the original. The developed image is then usually transferred from the photoreceptor surface to a final support material, such as paper, and the toner image is fixed thereto to form a permanent record corresponding to the original. While for clarity sake, the present invention will be described relative to an electrostatic marking system, it should be understood that the present invention can be used in any marking system, including offset and other printers, multifunctional devices, copiers, duplicators, fax, non-electrophotographic image forming and marking devices or other suitable office equipment generally. All of these marking systems are included within the scope of this invention.

It is usually the practice to install an electrostatic or other marking apparatus centrally in an office where it is accessible to all employees. Some of these marking machines are color systems and some are monochrome. Usage of these machines and their supplies are relatively expensive and means have been used in the past to prevent employees from using these machines for personal non-business purposes. For that matter, the cost of color printing and charges from personal use is sometimes a barrier to deployment of color printers in both smaller and larger companies. Often access and use of color printing is restricted to business use and some companies decide because of these problems not to provide color printers at all. Some of the overhead costs involved when employees freely use these marking systems for non-business use are so high that it discourages companies from installing these complex systems. Also, enforcing strict usage and providing codes, billing methods, etc. for usage can be complicated and time consuming to administer.

SUMMARY

The embodiments of the present invention provide a creative process, apparatus and system for allowing owners of color (or monochrome) marking apparatus to actually encourage employees to use the apparatus and consequently make money from non-business/personal use of office marking equipment. Thus, instead of being overhead costs for the business copier or marking apparatus, personal use becomes a source of revenue. In a preferred embodiment of the invention, the apparatus supplier (such as Xerox Corp.) manages the access, billing, and accounting for said personal use of equipment located at the business premises and also collects payments. Personal users would pre-pay the apparatus supplier (such as Xerox Corp.) to gain access to print privileges and the business owners receive compensation from the supplier for enabling such personal use. It is, thus, an advantageous feature of the present invention that the business owner profits instead of losing from personal use of his/her print equipment. The apparatus supplier in turn benefits from increased equipment placements and use. The embodiments of this invention are enabled by a networked deployment of making systems and by suitable technologies that allow the invention to be practiced.

The embodiments of this invention can be used in systems of color copiers or printers, monochrome copiers or printers, fax machines, multifunction machines (such as the Xerox "Work Center Pro.40" or "Work Center Pro.65" or any combinations of these systems. For purposes of clarity, the invention will be described as "marking equipment or systems". This term will include all of the above systems. Also, for clarity in the disclosure and claims herein, the "owner" of the marking equipment will be usually designated as "Employer" and the "user" will be designated as the "Employee"; however "Employer" will include any owner and the term "Employee" will include any user.

The identify means and communication means used can be any suitable system including user identification by a user's credit card, employee number, user code etc. Any suitable electronic print tracking and monitoring system, such as "Auditron" or "P Counter", or other proprietary or public systems for tracking prints may be used. P Counter is presently being used to track student-users each time they print or use the school's equipment. A printing account is set up at P Counter for each user. Funds can be added to their account. Prices can be assigned for number of copies, paper size, color or monochrome, etc. Every time a print is made by the user, the dollar value will be deducted from the user's account. When the balance in the user's account is $0, the user will be informed and their identifying code will be not be accepted until adequate funds are deposited in their account at which time they will be able to print.

Any suitable tracking software such as P Counter may be used. Studies show that just by installing tracking software, the print volume decreases between 10-15%. The present invention provides a means of not discouraging employee usage but rather encouraging employee usage with monetary benefits to the employer-owner.

User billing can be monthly or can be prepaid as in payment systems associated with P Counter's system.

An advantage of the present system is that the employer does not need to be involved in the logistics of accounting and billing for personal use except for hosting the equipment or system used which in the desired embodiment is installed for business use. Most small companies presently do not have the infrastructure nor time or experience to administer a system such as the presently described embodiments. In addition, the process is likely to be cost-ineffective on the individual small businesses/locations, whereas a larger operation across different businesses operated by the equipment supplier is cost-effective. With the deployment of the present invention, rather than being concerned that their equipment is being used by employees and others for non-business purposes, the owners will encourage private use since it now becomes a source of income to them, such as a portion of the amount received by the administrator or such as a volume commission. Also, any revenues due to the owner can be deducted from the contractual amount owed by the owner to the installer-provider-administrator, such as Xerox Corporation. An advantage to an embodiment of this invention is since color printers are relatively expensive, any method of alleviating or reducing the cost will allow smaller companies to afford installing, such a color system.

Any suitable software of other systems can be used to administer the system of the present invention. A system such as "PCounter X Audition" may be used, or an alternate system may be developed. Pcounter X Auditron (PXA), is a dedicated product for Xerox machines enabling automatic upload of user and Account codes and download of log files from Xerox machines to Pcounter.

PXA works with any Xerox multifunction devices which supports the Xerox Network Accounting option. This option allows third party software to communicate to the machine with a bidirectional dialog.

User and/or Account code is entered on Xerox machine display, and information is added to the log.

PXA is a fully automatic product, which means that it needs to be set up once and hereafter will the process of updating User codes, Account codes, log-files be automated.

To print to the multifunction devices working with the Xerox Network Accounting and PXA, the user will either just print the job as usual and this job will be accounted with a default user ID and client code, or a CenterWare PopUp window will ask him to type a user ID and client code.

To make a copy, the user will have to identify himself at the copier operator panel and type a client code or a password, or alternately by machine input, such as by scanning a printed bar code confirmation provided to the user at the time of submission of the print job, or using a stored token on a smart card or other device. This authentication sequence may be done locally at the copier and or may utilize network resources in order to access are remote repository. Such systems for identification and transaction management are well known and in common use in electronic commerce.

Several Xerox copiers and multi-functions have a feature to create Services or Client codes. All uses will need to enter a code at the copier panel to be allowed to do any copy. This feature is called AUDITRON, but this feature cannot export any data, and does not support the network print jobs. To allow copiers to communicate with the outside world, Xerox has developed The Network Accounting, which is equivalent to a "Networked Auditron."

The electrostatic or electrophotographic marking system or apparatus used comprises an apparatus with the "customary processing stations". These would include a charging station, an exposure station, a development station, a transfer station, a detack station, a fusing station and a cleaning station. Therefore, when the term "customary processing stations" is used in this disclosure and claims, the above-listed processing stations are included. In the apparatus is a communication component enabled to convey the user identity from the apparatus to an administrator, usually the company providing the machine (such as Xerox Corporation). There is a component in the system used by the administrator to determine time and costs incurred by the user. Included in the system is a communication component provided between the administrator and the owner of the marking system. The present system can include the option of managing the account completely on site (or on the device itself and do batch mode communications from time to time). This would be similar to credit card or i.d. card based systems.

As above noted, to summarize the embodiments of this process or system would allow employees to use their employer's marking equipment for the employees personal use. The employee in one embodiment would pre-pay the supplier (administrator) a fixed or predetermined fee for this service. The supplier would administer the service with little or no involvement by the employer or owner. The administrator would then reimburse or pay the employer a part of this fee so that the employee's personal usage becomes a source of income rather than overhead for the employer. An important aspect of this system is that it requires little involvement from the equipment owner or employer. The embodiments of this invention enable rather than restrict non-business personal use of marking equipment. As above noted, from the business owner's perspective, there are no costs and the business owner actually earns money when his or her employees use the marking equipment for personal use.

In one embodiment related to color printers, this invention addresses one of the barriers to the deployment of color printers in office environments. Due to the higher cost of color in comparison to black and white, a common concern of business users is that deployment of color printers will increase their printing costs. Though business-related use may be justified by the corresponding increase in value, personal/non-business use of openly accessible printers can increase costs without a corresponding increase in business value. For this reason, a lot of businesses currently either severely restrict access to color printers or choose not to deploy them at all.

From an individual user perspective, color hardcopy is often most desirable for personalized communication. It is particularly widespread in personal/non-business applications such as invitations/greeting cards, newsletters/fundraising mailings, vacation photo-journals, and the like. Home (inkjet) printers tend to be too expensive for these applications. Commercial copy companies are not only expensive (due to infrastructure costs) but also pose a significant inconvenience—due to the time and inconvenience for travel as well as uncertainty in cost until you actually visit the printing facility.

Embodiments of the present invention arise from observing that by following a new business method that exploits the network and computing infrastructure, we can not only remove the former barrier but also enable applications of the type described above for individual users at significantly lower cost and greater convenience. The required networking and computing infrastructure is already ubiquitous in today's office and home environments. In the following, this method is described in its most elementary form, several other variations are possible, some of which are described subsequently.

One or more color printers are installed in an employer-customer environment such that general users or employees have physical access to the printers but are not (by default) authorized to print to the color printers over the office network. Any user can, however, make use of the color printers by directly submitting the color print job along with appropriate payment to the "Supplier" service via the web and pick up their printed job from the printer (to which they have physical access). Actual printing and release of the printed pages from the printer may be automatic or may be controlled by a pass-code that the party doing the submission is provided at the time of payment. Business owners may be offered incentives to deploy the present invention by sharing the profits arising from the personal use with them. Underlying technologies required to ensure secure and non-repudiable operation of both the print job submission and control at the printer as well as to handle payment are already widely deployed as part of web-browsers and operating systems, etc.

Several enhancements or modifications of the basic service of this invention are possible.

1. If the printers incorporate readers for smart-cards, RFIDs, bar-codes or data-glyphs, these could be used to control the release of a print at the printer in a more automated and user-friendly way (instead of requiring the user to enter a code). Biometric identification, if available at the printer, may also be similarly used.

2. The invention may be beneficially combined with a variety of other services related to content hosting and management for consumers as well as document layout and design. These could either be Supplier supplied or arranged through partnership agreements. Thus, a user may choose to upload their content from home onto a Provider service that could also offer design templates, etc. and possibly cost estimates based on the job (and possibly on the printer model, if known). Once at work in the office, they could access the job through the same service and release it to the printer in their office.

3. Pricing can be dynamically controlled instead of using a fixed per page cost with estimates based on the specific job characteristics such as color coverage, etc. This would be a big plus in cases where color is extremely useful but only on a small subset of the total pages in a document.

4. Enhanced device specific functionality, such as Xerox Gloss-Marks may be made available to users in the design process (for instance by maintaining device profiles). These are particularly attractive in the greeting card/birthday invitation-type applications.

5. Device centric services and other network services can provide the infrastructure for operation of such a service with minimum disruption to the environment of the customer in whose facilities the printers are installed. Thus, jobs submitted from within the office environment would need to communicate only the (low bandwidth) payment and control information with Provider servers external to the customer site and the print job itself could be routed directly to the printer.

6. If a service of this type is deployed on a common framework, it may also be a potentially useful model for black and white printing—for instance, in university dorms, etc. where a student could host a printer and offer print services to others.

7. The suggestion in the above description is that no user has default printing privileges on the color printers in the office environment. By using user-based tracking and accounting (see, for example, the NetSpot Accountant feature in Canon MEAP) more fine grained control of default printing privileges is possible. Some users identified as having business need may be allowed to print to the color printers by default. Alternately, everyone may go through present embodiments and certain accounts may be established for business use. Note that while one may suggest that the entire accounting may be handled by the business that runs the office, this will usually not be an attractive proposition for the business.

By "Providers" as used throughout the specification and claims include companies such as Xerox, Canon, Ricoh, etc.

BRIEF DESCRIPTION OF THE DRAWINGS

The FIGURE illustrates the general components of an embodiment of the system of this invention.

DETAILED DISCUSSION OF DRAWINGS AND PREFERRED EMBODIMENTS

The drawing shows a marking apparatus 1. However, any color or monochrome apparatus can be used in the present system. A non-business user 2 would use the apparatus 1, would be identified as the user and this information conveyed to the administrator supplier such as Xerox Corporation 3. The apparatus 1 would include a component to identify the user and a component that will convey and transfer this and other information to the administrator 3. In the system, a component will be provided to receive information from the apparatus 1 and sent information from the administrator to the business apparatus owner 4 such as usage, user and owner's commission. Thus, the marking prints 5 made by employee 2 will be a source of income to employer 4. The term "employee" includes anyone other than the owner of apparatus 1. "Provider" includes the supplier of the equipment and "Employer" includes any owner of the equipment or machine.

In summary, the embodiments herein described provides a process of allowing employees to use their employer's marking equipment for employee's personal use. This process comprises a supplier providing at employer's facilities said marking equipment. The employee will pre-pay or make other payments to said supplier for a predetermined periodic fixed fee for this service. The supplier is enabled to administer service via communication(s) from equipment and subsequently reimburse employer at least part of the fee received from employee.

The user has an account with the supplier that is administered to enable the user to make copies on the equipment within parameters of the account.

The marking equipment is selected from the group consisting of electrostatic and non-electrostatic color printers, color copiers, monochrome printers, monochrome copiers, fax machines, multifunction machines and mixtures thereof.

The supplier periodically pays the owner an amount or commission based upon the user's incurred costs for said use.

In one embodiment said equipment is a color printer or color copier.

In one or all embodiments there is provided a method of initiating or increasing revenue derived from a marking machine. This method comprises a system wherein a provider installs the machine at an employer-owner's location. The provider is supplying a component in the machine which identifies an employee-user and provides another component enabled to record specifics of use by the user. Also, a communication component between the machine and the provider is used for arranging payments made to the provider by the user. Subsequently, said provider will share said payments with said employer-user.

The provider administers substantially the entire said system with little or no involvement by the employer.

This system permits the employee to make personal copies on the machine within parameters of an arrangement with the provider.

In an embodiment, the provider deducts from any balance owed by said employer-owner any amounts of payments due the employer-owner.

Obviously, said system is agreed upon by the employer prior to initiation and administration.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A process of allowing employees to use their employer's marking equipment for employee's personal use which comprises a supplier providing at employer's facilities said marking equipment, accepting from said employee a document for printing and payment to said supplier a predetermined fixed fee for this service, said supplier enabled to administer said service via communication(s) from said equipment and subsequently reimburse said employer at least part of said fee received from said employee.

2. The process of claim 1 wherein said user has an account with said supplier that is administered to enable said user to make copies within parameters of said account.

3. The process of claim 1 wherein said marking equipment is selected from the group consisting of color printers, color copiers, monochrome printers, monochrome copiers, fax machines, multifunction machines and mixtures thereof.

4. The process of claim 1 wherein said supplier periodically pays said owner an amount or commission based upon said user's incurred costs for said use.

5. The process of claim 1 wherein said equipment is an electrostatic color printer.

6. A method of initiating or increasing revenue derived from a marking machine which comprises a system wherein a provider installs said machine at an owner's location, said provider supplying a component in said machine which identifies a user, providing another component enabled to record specifics of use, providing a communication component between said machine and said provider, arranging payments made to said provider by said user, and subsequently said provider sharing said payments with said owner.

7. The method of claims 6 wherein said machines is an electrostatic color printer.

8. The method of claim 6 wherein said provider administers substantially the entire said system with little or no involvement by said owner.

9. The method of claim 6 wherein said system permits said user to make personal copies on said machine within parameters of an arrangement with said provider.

10. The method of claim 6 wherein said marking machine is selected from the group consisting of color printers, color copiers, monochrome printers, monochrome copiers, fax machines, multifunction machines and mixtures thereof.

11. The method of claim 6 wherein said provider pays said owner an amount of money based upon said payments.

12. The method of claim 6 wherein said provider deducts from any balance owned by said owner any amounts of said payments due said owner.

13. The method of claim 6 wherein said system is agreed upon by said owner prior to initiation.

14. The method if claim 6, wherein said owner is an employer and said user is an employee of the owner's business.

15. A marking system or apparatus comprising an apparatus with the customary processing stations of such a marking system, said system provided at a location of an owner or employer and enabled to produce marked copies of a desired indicia, said system comprising an identification and permission component enabled to indicate identity of a user other than said owner including an employee, a communication component in said apparatus enabled to convey said identity from said apparatus to an administrator of said system, a component in said system used by said administrator to determine time and cost incurred by said user, and a communication component provided between said administrator and said owner of said marking system which is enabled to track and advise user of costs and accounting aspects of said permission component, and wherein said supplier periodically pays said owner an amount of commission based upon said user's incurred costs for said use.

16. The system of claim 15 wherein said user has an account with said supplier that is administered to enable said user to make copies within parameters of said account.

17. The system of claim 15 wherein said marking equipment is selected from the group consisting of color printers, color copiers, monochrome printers, monochrome copiers, fax machines, multifunction machines and mixtures thereof.

18. The system of claim 15 wherein said equipment is an electrostatic color printer.

* * * * *